United States Patent [19]

Gibson

[11] Patent Number: 5,049,413

[45] Date of Patent: Sep. 17, 1991

[54] METHOD FOR CLEANING A BALL-LIKE OBJECT ADAPTED FOR SPORT AND RECREATIONAL USE

[76] Inventor: William B. Gibson, Rte. 5, Box 238, Kings Mountain, N.C. 28086

[21] Appl. No.: 429,984

[22] Filed: Nov. 1, 1989

[51] Int. Cl.[5] ..... B32B 35/00; A46B 13/00

[52] U.S. Cl. ..... 427/140; 427/277; 427/323; 15/21.2; 15/22.2; 51/323; 134/7

[58] Field of Search ..... 427/203, 11, 140, 154, 427/290, 277, 323; 15/21 A, 21 B, 21 C, 21 D; 51/289 S, 326, DIG. 3, 323; 134/7

[56] References Cited

U.S. PATENT DOCUMENTS

| | | | |
|---|---|---|---|
| 2,431 | 1/1842 | Ronald et al. | 427/290 |
| 466,429 | 1/1892 | Sampson | 427/290 |
| 1,141,263 | 6/1915 | Pease | 51/DIG. 13 |
| 2,092,686 | 9/1937 | Wilson | 51/323 |
| 2,161,504 | 6/1939 | Campbell | 134/7 |
| 2,708,157 | 3/1953 | Houser | 51/323 |
| 3,116,578 | 1/1964 | Bottler | 134/7 |

*Primary Examiner*—Michael Lusignan
*Assistant Examiner*—Diana L. Dudash
*Attorney, Agent, or Firm*—Shefte, Pinckney & Sawyer

[57] ABSTRACT

A method for cleaning a leather ball adapted for sport and recreational use is provided. The method includes frictionally contacting the cover of the ball with an abrasive medium sufficient to completely dislodge some of the soil and debris thereon and partially dislodge other soil and debris but insufficient to substantially abrade the cover. The method additionally includes the step of applying a substantially moisture-free particulate material comprising poly tri-sodium phosphate to the cover to completely dislodge any remaining soil and debris following the frictional contacting step. According to one aspect of the method, a conical rotating abrasive surface is oriented relative to a predetermined direction along a seam of the ball and applied to the ball laterally to each side of the seam to frictionally dislodge the soil and debris.

20 Claims, 1 Drawing Sheet

METHOD FOR CLEANING A BALL-LIKE OBJECT ADAPTED FOR SPORT AND RECREATIONAL USE

BACKGROUND OF THE INVENTION

The present invention relates to a method for cleaning a ball-like object adapted for sport and recreational use and, more particularly, a method for cleaning the leather outer cover of a ball-like object adapted for sport and recreational use.

For a number of reasons, such as durability, gripability and malleability, leather has shown itself to be a particularly desirable material for use as the cover of baseballs, footballs and other ball-like objects used in sport and recreational environments. For example, baseballs and softballs are typically constructed with outer covers comprising several pieces of treated leather which are configured such that their edges are contiguous when assembled into the three-dimensional outer cover. The outer covers of baseballs and softballs typically have a white color and the outer cover is treated to exhibit a smooth "hand" or feel and a glossy appearance.

As can be understood, baseball and softball outer covers gradually but persistently, lose their original smooth "hand" and glossy appearance under the onslaught of dirt, grime and other soiling substances found in abundance in the sport and recreational environments in which baseballs and softballs are used. The outer cover commonly takes on a yellowish-brown overall appearance and certain portions thereof may be even browner in appearance due to localized scuffing or other forces which tend to drive soil and other debris relatively deeply into the leather outer cover.

The cover portions of the baseball are generally universally of a white color. However, the use of the baseball on a typical baseball playing surface which, in regulation play, is a playing field having a combination of grass and dirt surfaces and, in non-regulation play, is more often than not a playing field composed principally of dirt, tend to increasingly soil the white colored surfaces of the baseball. Although the durability and performance of the baseball is not in any significant manner affected by the gradual accumulation of the dirt on its outer cover, those who use such baseballs greatly prefer, for a number of reasons, to use only those baseballs which still exhibit their original white or near white color. The contrast of the white baseball against the reddish or brown soil or against the green grass enhances the ability of the baseball players to locate the baseball. Additionally, the accumulation of the brownish coloring on the outer cover of the baseball tends to gradually diminish the semi-glossy appearance of the ball and, more significantly, tends to diminish the relatively smooth "hand" or feel of the baseball which baseball players tend to prefer. Accordingly, in major league baseball activities, it is common practice for new baseballs to be used even during practice sessions. On the other hand, in other baseball activities and, especially, amateur baseball activities, the funds for equipment purchases are relatively much more limited and it is therefore not feasible to replace the supply of baseballs in use after only a relatively short period of use. Nonetheless, both professional and amateur baseball players prefer to use baseballs having a "new" look, irrespective of the level of play.

Accordingly, the need exists for a method for cleaning ball-like sport and recreational objects composed of leather in an economical manner.

SUMMARY OF THE INVENTION

The present invention provides a method for economically and reliably cleaning ball-like sport and recreational objects composed of leather which does not significantly alter, or detract from, the performance characteristics, such as flight behavior, of the ball-like object.

Briefly described, the present invention provides a method for cleaning soil and other debris from a ball-like object adapted for sport and recreational use, the ball-like object being of the type having a leather-like cover sewn in place by stitching across adjoining portions of the cover, the adjoining portions defining a seam therebetween. The method includes frictionally contacting the cover with an abrasive medium sufficient to completely dislodge some of the soil and debris and partially dislodge other soil and debris on the cover but insufficient to substantially abrade the cover and, after frictionally contacting the cover, applying a substantially moisture-free particulate material to the cover to completely dislodge at least some of the other soil and debris.

According to one aspect of the present invention, the frictionally contacting step includes frictionally contacting the cover substantially only at the region of the seams and frictionally contacting the non-seam regions of the cover following one material applying step. The method preferably also includes further applying a substantially moisture-free particulate material to the cover following the step of frictionally contacting the non-seam regions of the cover and coating the cover with a coating material formed of beeswax following the frictional contacting step.

The material applying step preferably includes relatively moving the cover and a material formed of poly tri-sodium phosphate. Preferably, the frictionally contacting step includes frictionally contacting the cover with a conical rotating abrasive surface.

In one form of the present invention, the method is used with a ball-like object of the type having a plurality of holes extending through the cover at locations laterally to each side of the seam and the stitching includes portions extending from the holes to the seam at an acute angle with respect to the seam, as measured in the same direction along the seam and the frictionally contacting step includes orienting the conical rotating abrasive surface with its direction of taper relative to the seam being in the same direction as the exposed portions of the stitching and applying the conical rotating abrasive surface laterally to each side of the seam.

DETAILED DESCRIPTION OF THE PREFERRED EMBODIMENT

Figure 1:
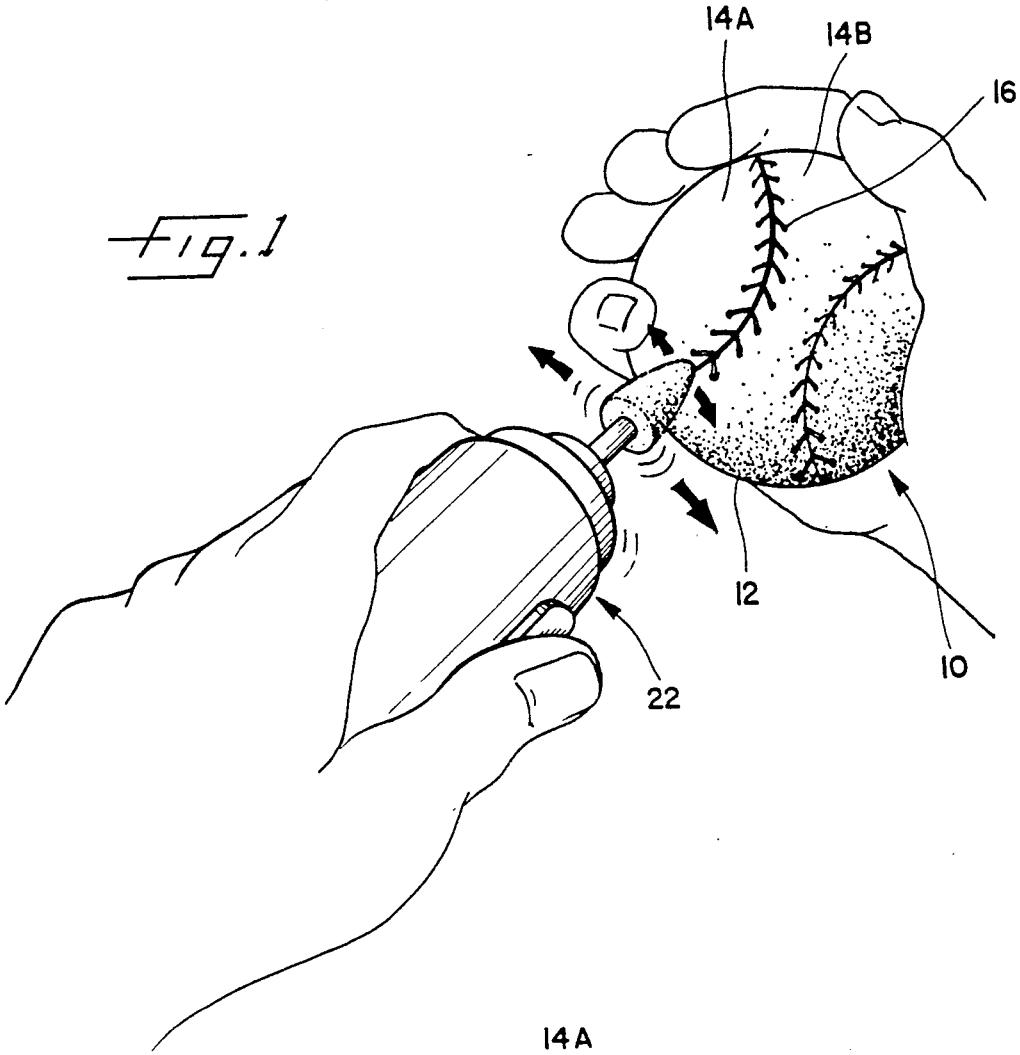
FIG. 1 is a perspective view of a baseball being cleaned in accordance with the method of the present invention.
Figure 2:
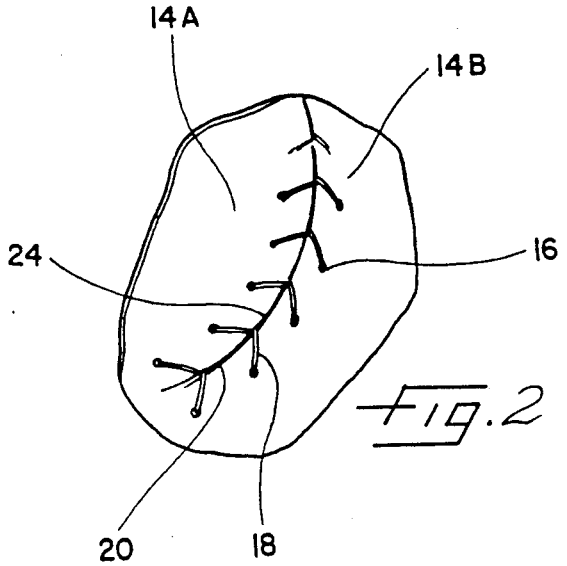
FIG. 2 is an exploded perspective view of a portion of the baseball shown in FIG. 1.

In accordance with the present invention, a method for cleaning a ball-like object adapted for sport and recreational use is provided. With reference to FIGS. 1 and 2, a ball-like object adapted for sport and recreational use such as, for example, a baseball 10, is commonly of the type having a cover 12 formed of a plurality of portions 14A, 14B. The baseball 10 is formed of leather specially treated to provide the baseball with an outer cover having desirable qualities for use in baseball-type sport and recreational activities. Specifically, the exposed surfaces of the cover portions 14A, 14B are finished to provide a generally smooth, relatively glossy finish. Additionally, the leather is treated such that it is sufficiently supple to resiliently absorb the impact of a baseball bat and to provide a suitable durability. In fact, the leather used in many commercially available baseballs is of such quality and durability that the effective life of the baseball may be far from over at the point in time in which the outer covers exhibit a relatively brownish and overall dirty appearance.

The portions 14A, 14B are compatibly configured with one another to be interconnected to one another along their respective edges. To this end, as seen in FIG. 2, each of the cover portions 14A, 14B is provided with a plurality of throughholes 16 spaced inwardly from the edge of the cover portion and generally uniformly spaced from one another. The throughholes 16 are adapted to receive a stitching 18 inserted therethrough and the stitching 18 extends alternately from the throughhole 16 of the cover portion 14A to a respective adjacent throughhole 16 of the cover portion 14B in a conventional stitching pattern to secure the cover portions 14A, 14B to one another along their respective edges. The respective adjacent edges of the cover portions 14A, 14B define a seam 20 therebetween. The seam 20 has a longitudinally extending centerline. The conventional stitching pattern of the stitches 18 results in a configuration in which the exposed portion of the stitching extends from the throughholes 16 to the seam 20 at an acute angle with respect to the seam as measured in the same direction along the centerline of the seam.

In accordance with the present invention, a method is provided to substantially restore a baseball or other ball-like object used in sport and recreational use to the appearance which the ball-like object had in its original condition. By way of illustration, the cleaning method of the present invention is discussed with respect to the cleaning of the baseball 10. Initially, the cover portions 14A, 14B of the baseball 10 are frictionally contacted with an abrasive medium 22 such as, for example, a power tool schematically illustrated in FIG. 1, in a manner sufficient to completely dislodge some of the soil and other discoloring debris and partially dislodge other soil and debris from the cover 12 but insufficient to substantially abrade the cover. In practice, it has been found that a hand-held, electrically powered rotary abrasive tool is particularly well suited for this step of frictionally contacting the cover portions 14A, 14B. One such hand-held rotating abrasive tool is sold under the trademark Moto-Tool® by the Dremel Division of Emerson Electric Company and includes an aluminum oxide wheel point identified as stock number 952. Such a rotary abrasive tool is capable of rotating a suitable abrasive bit, such as, for example, a generally conically shaped abrasive tool bit, at speeds up to 30,000 revolutions per minute.

The abrasive medium 22 is applied, to the extent possible, to the entire extent of the cover portions 14A, 14B including those portions thereof adjacent the seam 20. It has been found in practice that, if a rotating conically shaped abrasive tool bit is used, the risk of damage to the stitching 18 is reduced if the conically shaped abrasive bit is held at a predetermined orientation relative to the seam 20 while the abrasive bit is applied to the cover 12. Specifically, the preferred predetermined orientation of the conically shaped abrasive tool bit is an orientation in which the direction of taper of the tool bit is in the same direction relative to the seam 20 as the direction of inclination of the stitches 18 relative to the centerline of the seam and the conical surface of the tool bit is substantially flush (i.e.—at only 2 to 5 degrees of inclination) with the cover portions 14A, 14B.

Preferably, the step of frictionally contacting the cover portions 14A, 14B with an abrasive medium is performed until only those regions of the cover 12 immediately adjacent the seam 20 continue to exhibit significant discoloration. As seen in FIG. 2, the remaining discoloration 24 lies immediately adjacent the seam 20.

The next step of the method of the present invention involves applying a substantially moisture-free particulate or granular material 24 such as, for example, poly tri-sodium phosphate, to the cover portions 14A, 14B to promote the complete dislodging of any remaining dirt or debris particles on the cover 12. In practice, it has been found that manually submerging and then moving the baseball 10 in an amount of poly tri-sodium phosphate for approximately 20 seconds serves to effectively dislodge and remove most of the visible soil and debris from the baseball.

Following the application of the particulate material 24 to the baseball 10, the abrasive medium is again applied to the cover portions 14A, 14B. Preferably, this further application of the abrasive medium to the baseball 10 is executed with significantly less direct force against the baseball than the first frictional contacting step. Following this further contacting of the baseball 10 in a frictional manner, the baseball is further subjected to an application of the particulate material 24 to assist in the removal of loose dirt or debris still present on the cover portions 14A, 14B.

The baseball 10 is now ready to be coated with an appropriate gloss-restoring material such as, for example, processed beeswax paste. A relatively very light coating of beeswax paste can be manually applied to the cover portions 14A, 14B to restore a relatively glossy finish to the baseball 10. It has been found that such a very light beeswax finish coating will sufficiently cure in twenty minutes for the baseball 10 to be used again in sport or recreational activity.

It has been found that, on average, a hardball-type baseball such as the baseball 10 can be cleaned in accordance with the cleaning method of the present invention in approximately five minutes, exclusive of the curing time for the beeswax finish coat. Moreover, it has been found that the cleaning method of the present invention is effective for removing relatively minor scuffs and scratches in addition to the soil and debris. Once a baseball has been reconditioned in accordance with the cleaning method of the present invention, the user can anticipate using the reconditioned baseball in a sport or recreational activity in the same manner as the baseball was used before the reconditioning. Of course, the reconditioned baseball will be subjected to the same soiling and staining conditions as it was before the reconditioning and the white or near white color of the newly reconditioned ball will gradually but increasingly give way to a brownish, soiled appearance. However, the cleaning method of the present invention can oftentimes prolong the effective useful life of a baseball by upwards of 50%. In fact, it has been found in practice that a baseball which has already been treated in accordance with the method of the present invention can, after it has been returned to further use, be successfully treated again in accordance with the method, thereby further extending the useful life of the ball.

Experience has shown that the amount of use to which the baseball has been subjected prior to reconditioning is a factor which influences the ultimate appearance of the ball following reconditioning. Specifically, it has been found that those balls which are reconditioned relatively soon after initially being put into use can be cleaned to virtually the same original white color while the ability to recondition balls which have been in use for relatively longer periods of time to their original white color generally decreases as the age of the ball increases. Thus, the cleaning method of the present invention has only limited effectiveness in cleaning baseballs which are cut, badly scuffed, have a number of "soft" spots or are in otherwise poor shape.

Although the cleaning method of the present invention has been described with respect to execution of the several frictional contacting and particulate material application steps in alternating manner, the present invention contemplates that the cleaning method encompasses any pattern of executing the frictional contacting and particulate material application steps. Additionally, the present invention contemplates that the application of a finish coating such as processed beeswax paste can be deleted.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A method for cleaning soil and other debris from a ball-like object adapted for sport and recreational use, the ball-like object being of the type having a leather cover sewn in place by stitching across adjoining portions of the cover, the adjoining portions defining a seam therebetween, comprising:

frictionally contacting the cover with an abrasive medium sufficient to completely dislodge some of the soil and debris and partially dislodge other soil and debris on the cover but insufficient to substantially abrade the cover; and after frictionally contacting the cover, applying a substantially moisture-free particulate material to the cover to completely dislodge at least some of the other soil and debris.

2. A method according to claim 1 and characterized further in that said frictionally contacting step includes frictionally contacting the cover only at the region of the seams.

3. A method according to claim 2 and characterized further in that said frictionally contacting step includes frictionally contacting the non-seam regions of the cover following said material applying step.

4. A method according to claim 3 and characterized further by further applying a substantially moisture-free particulate material to the cover following said step of frictionally contacting the non-seam regions of the cover.

5. A method according to claim 1 and characterized further by coating the cover with a coating material formed of beeswax following said frictional contacting step.

6. A method according to claim 4 and characterized further by coating the cover with a coating material formed of beeswax following said further material applying step.

7. A method according to claim 1 and characterized further in that said material applying step includes relatively moving the cover and a material formed of poly tri-sodium phosphate.

8. A method according to claim 4 and characterized further in that said further material applying step includes moving the cover and a material formed of poly tri-sodium phosphate relative to one another.

9. A method according to claim 1 and characterized further in that said frictionally contacting step includes frictionally contacting the cover with a rotating abrasive surface.

10. A method according to claim 9 and characterized further in that said frictionally contacting the cover with a rotating abrasive surface includes frictionally contacting the cover with a conical rotating abrasive surface.

11. A method according to claim 10 wherein the ball-like object is of the type having a plurality of holes extending through the cover at locations laterally to each side of the seam and the stitching includes portions extending from the holes to the seam at an acute angle with respect to the seam, as measured in the same direction along the seam and characterized further in that said frictionally contacting step includes orienting said conical rotating abrasive surface with its direction of taper relative to the seam being in the same direction as the exposed portions of the stitching and applying said conical rotating abrasive surface laterally to each side of the seam.

12. A method for restoring the leather cover of a ball-like object to its original while color from a condition in which the original white color of the leather cover is discolored by soil and other debris, the ball-like object being of the type adapted for sport and recreational use and the leather cover being sewn in place by stitching across a seam defined between adjoining portions of the cover, comprising:

frictionally contacting the cover with an abrasive medium sufficient to dislodge at least some of the discoloring soil and debris while minimizing the extent to which any abrasion of the cover occurs due to the frictional contacting of the cover;

after frictionally contacting the cover and before the application of any liquid thereto, applying a dry particulate material to the cover occurs due to the frictional contacting of the cover;

after frictionally contacting the cover and before the application of any liquid thereto, applying a dry particulate material to the cover to further dislodge soil and debris from the cover; and after said dry particulate applying step, coating the cover with a coating material formed of beeswax, the composition of the beeswax being selected to minimize any discoloration of the ball-like object due to the coating thereof.

13. A method according to claim 12 and characterized further in that said frictionally contacting step includes frictionally contacting the cover substantially only at the region of the seams.

14. A method according to claim 13 and characterized further in that said frictionally contacting step includes frictionally contacting the non-seam regions of the cover following said material applying step.

15. A method according to claim 14 and characterized further by further applying a particulate material to the cover following said step of frictionally contacting the non-seam regions of the cover.

16. A method according to claim 12 and characterized further in that said material applying step includes relatively moving the cover and a material formed of poly tri-sodium phosphate.

17. A method according to claim 15 and characterized further in that said further material applying step includes relatively moving the cover and a material formed of poly tri-sodium phosphate.

18. A method according to claim 12 and characterized further in that said frictionally contacting step includes frictionally contacting the cover with a rotating abrasive surface.

19. A method according to claim 15 and characterized further in that said frictionally contacting the cover with a rotating abrasive surface includes frictionally contacting the cover with a conical rotating abrasive surface.

20. A method according to claim 19 wherein the ball object is of the type having a plurality of holes extending through the cover at locations laterally to each side of the seam and the stitching includes portions extending from the holes to the seam at an acute angle with respect to the seam, as measured in the same direction along the seam and characterized further in that said frictionally contacting step includes orienting said conical rotating abrasive surface with its direction of tape relative to the seam being in the same direction as the exposed portions of the stitching and applying said conical rotating abrasive surface laterally to each side of the seam.

* * * * *